US005714732A

United States Patent [19]

Lee

[11] Patent Number: 5,714,732

[45] Date of Patent: Feb. 3, 1998

[54] LATCHING SWITCH

[75] Inventor: James Sungioun Lee, Niles, Ohio

[73] Assignee: Packard Hughes Interconnect Company, Irvine, Calif.

[21] Appl. No.: 724,288

[22] Filed: Sep. 16, 1996

[51] Int. Cl.[6] ..... H01H 21/00

[52] U.S. Cl. ..... 200/6 R; 200/553

[58] Field of Search ..... 200/4, 5 R, 5 A, 200/6 R–6 C, 16 R, 16 C, 16 D, 553, 556–558, 561, 318, 321–325, 327, 339

[56] References Cited

U.S. PATENT DOCUMENTS

| | | | |
|---|---|---|---|
| 3,604,868 | 9/1971 | Batcheller et al. | 200/67 G |
| 4,904,833 | 2/1990 | Sata et al. | 200/557 |
| 5,158,172 | 10/1992 | Roeser et al. | 200/553 |
| 5,426,275 | 6/1995 | Maeda et al. | 200/553 |

*Primary Examiner*—Michael L. Gellner
*Assistant Examiner*—Michael A. Friedhofer
*Attorney, Agent, or Firm*—Cary W. Brooks

[57] ABSTRACT

This invention includes a switch using two flexible domes positioned to engage the underside of a lever bar. The lever bar includes a top substantially flat surface with the exception of two spaced apart ramped nubs. A keycap is positioned over the lever bar for pivotal movement in a housing carrying the same. The keycap includes two spaced apart downwardly extending legs for engaging the top surface of the lever bar. The keycap is movable from a first position wherein the two downwardly extending legs straddle the outside of the two ramped nubs and wherein both flexible domes are fully extended and not collapsed. The elongated keycap may be depressed on a first end causing a first leg of the keycap to force the lever bar downward collapsing a first dome and closing a circuit underneath the dome. As the keycap is depressed the first leg moves over a first ramped nub and is latched in a position between the two ramped nubs. In this second position the second dome is fully extended. The keycap may be moved to a third position by depressing a second end of the keycap forcing the second leg to press downward on the lever bar causing the second dome to collapse and close a circuit underneath the same. As the second end of the keycap is depressed, the second leg moves over the ramped surface of the second nub and is latched in a position between the two nubs. In this third position, the first dome is and fully extended and not collapsed.

5 Claims, 3 Drawing Sheets

LATCHING SWITCH

TECHNICAL FIELD

This invention relates to switches, and more particularly to switches that latch.

BACKGROUND OF THE INVENTION

Many of the prior art latching switches use a spring and metal-ball method to latch the switches between two different positions. These systems include numerous parts and are difficult to construct and assemble thus making them costly compared to the present invention. Further, these spring and metal-ball switches have a tactile field which is inconsistent and relatively poor compared to the present invention.

The present invention provides advantages and alternatives over the prior art.

SUMMARY OF THE INVENTION

This invention includes a switch using two flexible domes positioned to engage the underside of a lever bar. The lever bar includes a top substantially flat surface with the exception of two spaced apart ramped nubs. A keycap is positioned over the lever bar for pivotal movement in a housing carrying the same. The keycap includes two spaced apart downwardly extending legs for engaging the top surface of the lever bar. The keycap is movable from a first position wherein the two downwardly extending legs straddle the outside of the two ramped nubs and wherein both flexible domes are fully extended and not collapsed. The elongated keycap may be depressed on a first end causing a first leg of the keycap to force the lever bar downward collapsing a first dome and closing a circuit underneath the dome. As the keycap is depressed the first leg moves over a first ramped nub and is latched in a position between the two ramped nubs. In this second position the second dome is fully extended. The keycap may be moved to a third position by depressing a second end of the keycap forcing the second leg to press downward on the lever bar causing the second dome to collapse and close a circuit underneath the same. As the second end of the keycap is depressed, the second leg moves over the ramped surface of the second nub and is latched in a position between the two nubs. In this third position, the first dome is and fully extended and not collapsed.

These and other objects, features and advantages of the present invention will become apparent from the following brief description of the drawings, detailed description and appended claims and drawings.

DETAILED DESCRIPTION

Figure 1:
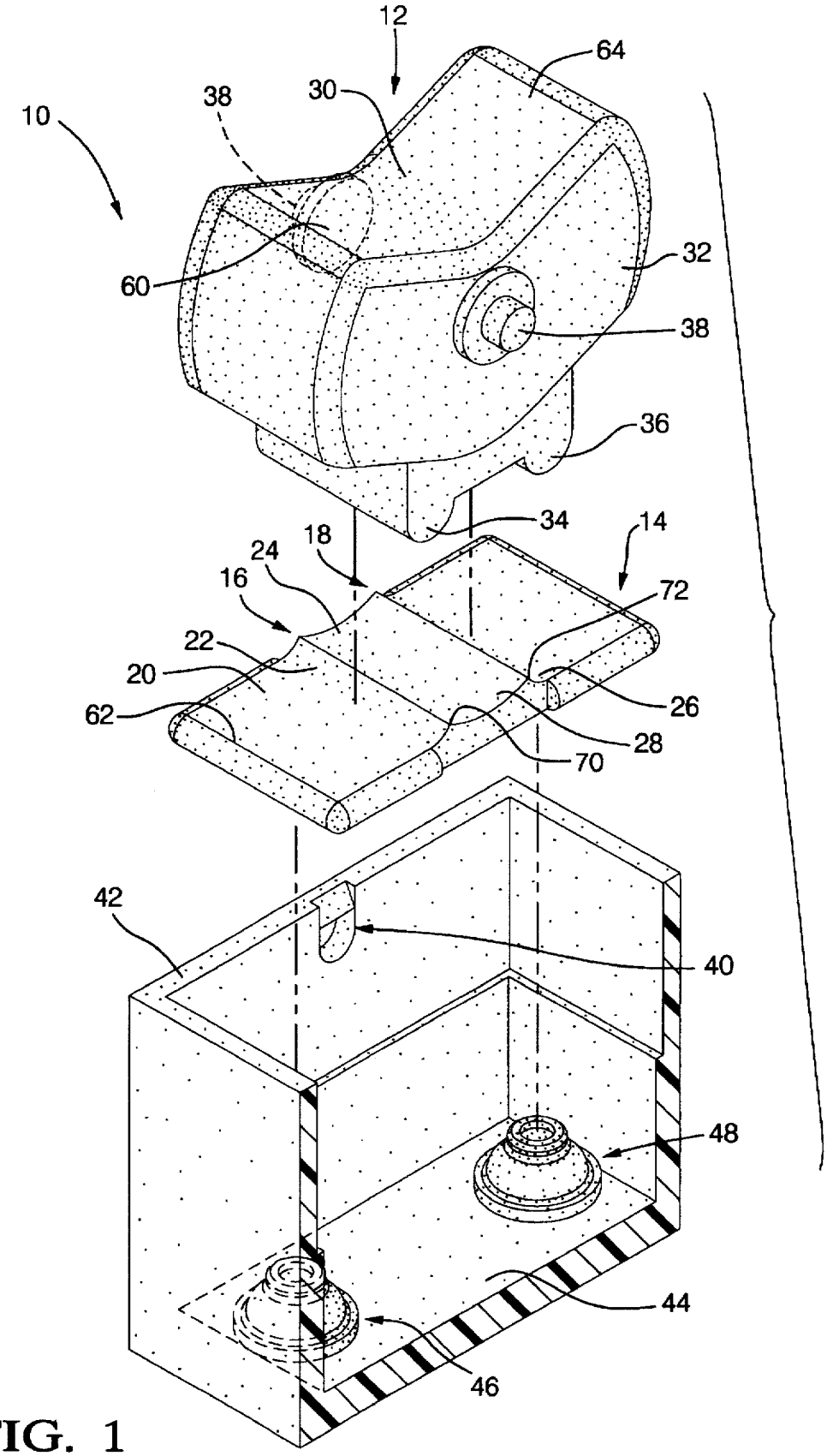
FIG. 1 is an exploded view of a keycap and lever bar according to the present invention.

FIG. 1 illustrates a switch 10 according to the present invention including a keycap 12 and lever bar 14 according to the present invention. The lever bar has a bottom surface and a top surface. Two spaced apart nubs 16, 18 extend upwardly from the top surface 20 of the lever bar 14 which is otherwise substantially flat. Each nub 16, 18 has opposed outside and inside ramped surfaces 22, 24 and 26, 28 respectively.

The keycap 12 preferably has an elongated structure including a top surface 30, a body 32 connected to the top surface and two spaced apart legs 34, 36 extending downwardly from the body. A pivot rod 38 extends outwardly from opposed sides of the body of the keycap to be received in a recess 40 formed in a housing 42 for pivotal movement in a housing.

Figure 2:
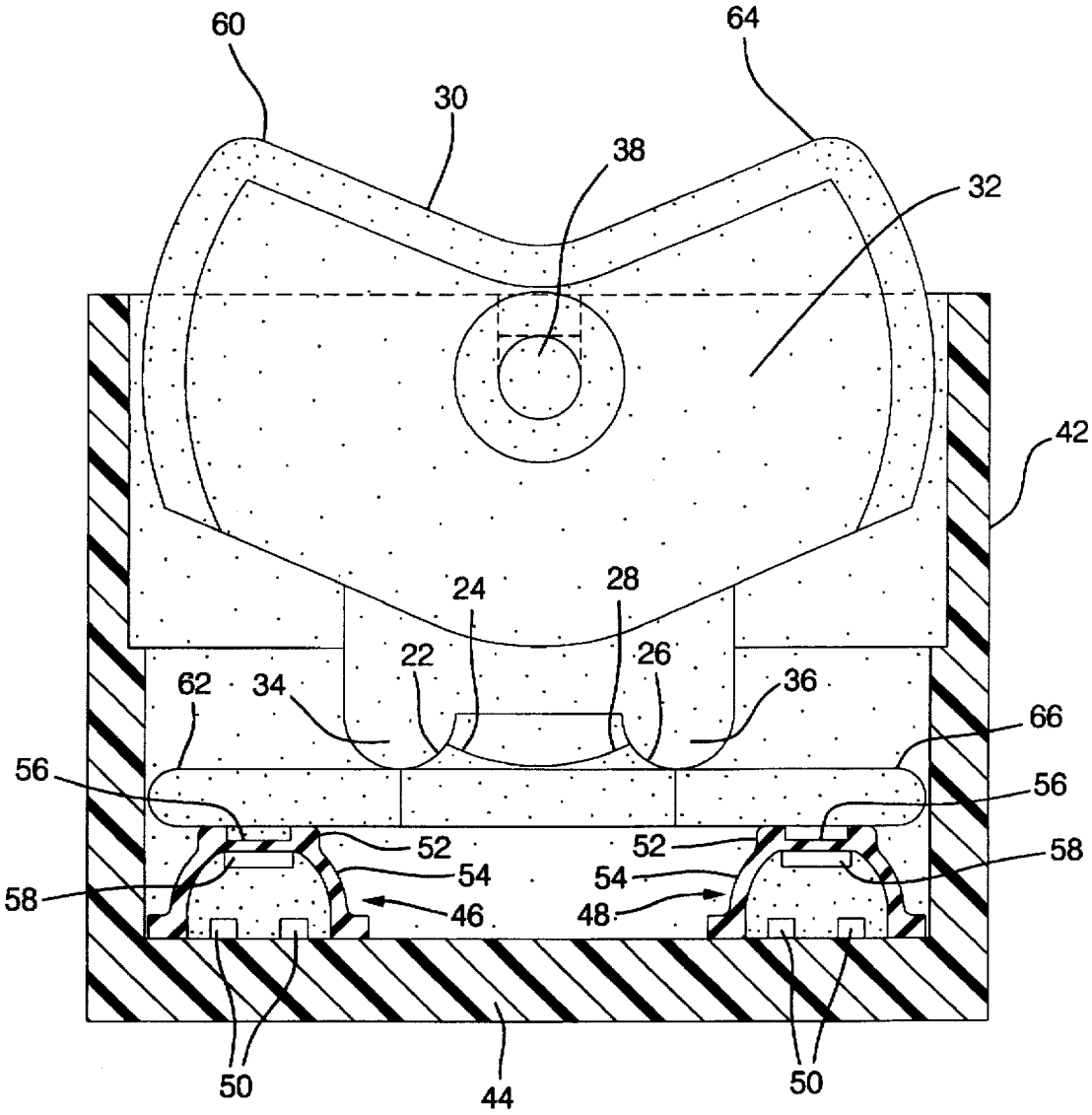
FIGS. 2–4 are partial sectioned side elevation views of a latching switch according to the present invention in first, second and third positions respectively.

As shown in FIG. 2 a pair of spaced apart nonmetallic, flexible dome structures 46, 48 are carried on a substrate 44 having a plurality of closely spaced contacts or ends of traces 50 of a printed circuit for each of the domed structures. The nonmetallic, flexible dome is preferably made from an elastomeric material such as silicone and has a resilient, annular ring 52 of a given thickness, and a downwardly extending flexible dome shaped wall 54. A thinner membrane 56 underlines the annular ring 52 and an electrically conductive pellet 58 is carried on the underside of the thinner membrane 56. As the dome is collapsed by the depression of one end of the keycap 12 and the corresponding rotation of the lever bar 14, the electrically conductive pellet 58 on the underside of the dome engages the spaced apart traces 50 closing the circuit and sending a signal to a device associated with the switch. Such a device might be typically in an automobile, a driver side window or mirror switch module.

Figure 3:
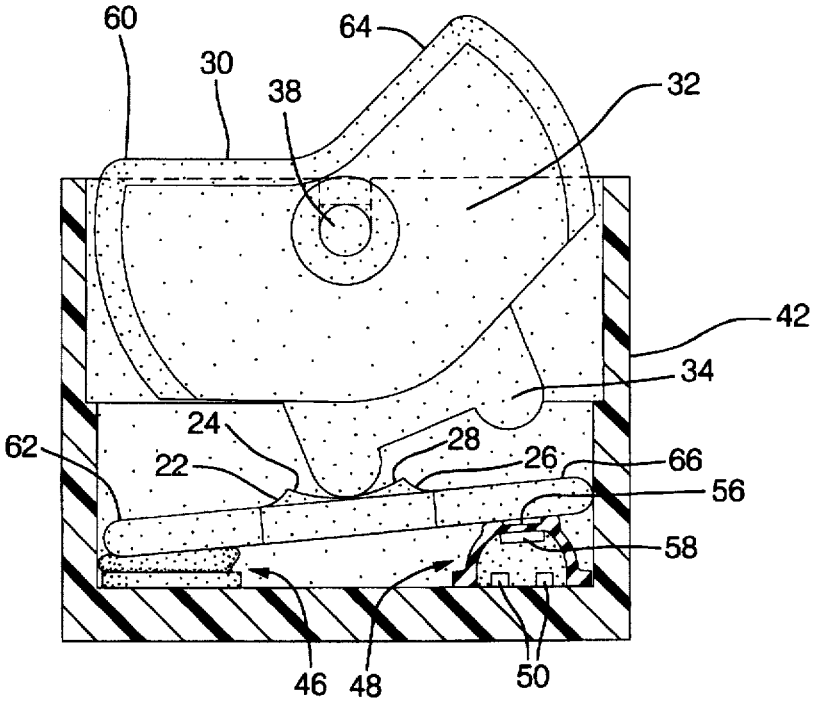

The keycap can be moved to and from first, second and third positions. In a first position (FIG. 2), the downwardly extending legs 34, 36 each straddle the outside ramped surfaces 22 and 26 respectively of the two nubs 16, 18 and both domes 46, 48 are filly extended and not collapsed. The keycap can be moved to a second position (FIG. 3) by depressing a first end 60 of the keycap causing the first leg 34 to push downward on the lever bar causing a first end 62 of the lever bar to rotate downwardly and collapse the first dome 46. As the first end 62 of the keycap is depressed, the first leg rides up the outside surface 22 of the first ramped nub 16 and over and down the inside ramped surface 24 to be latched between the two ramped surfaces 16, 18. In this second position, the second dome 48 is fully extended and not collapsed.

Figure 4:
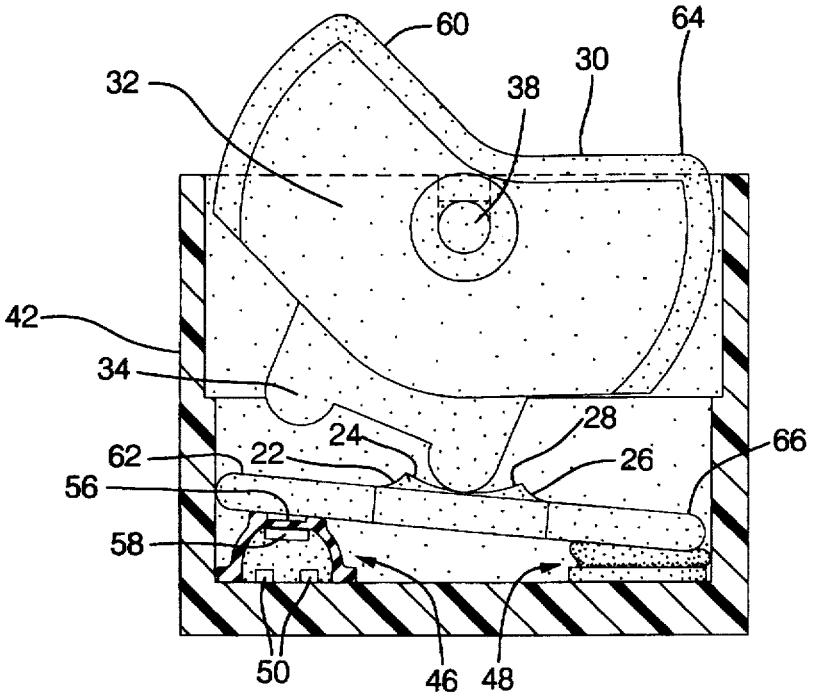

The keycap may be moved to a third position (FIG. 4) by depressing a second end 64 of the keycap causing a second leg 36 to press down on the lever bar and causing a second end 66 of the lever bar to rotate downwardly collapsing a second dome 48 and closing the circuit thereunder. As the second end 64 of the keycap is depressed the second leg 34 rides up an outside ramped surface 26 of the nub and down inside ramped surface 28 to stop and be latched between the two ramped nubs 16, 18. In this third position, the first dome 46 is fully extended and not collapsed.

Preferably, the apex 70 of the first nub 16 is positioned on the lever bar, with respect to the center of the first dome 46, a distance of about one third the distance between the two domes 46, 48. Likewise, the apex 72 of the second nub 18 is positioned on the lever bar, with respect to the center of the second dome 48, a distance of one third of the distance between the centers of the two domes 16, 18.

I claim:

1. A latching switch comprising:

an elongated keycap for movement between first, second and third positions, said keycap having a top surface connected to a body and two spaced apart downwardly extending legs connected to the body, the keycap being positioned for engagement with a lever bar, the lever bar having a top surface and a bottom surface, the top surface of the lever bar having two spaced apart nubs extending upwardly therefrom, a pair of spaced apart flexible domes underlying the lever bar, the flexible domes each overlying a substrate having spaced apart electrical traces of an electrical circuit positioned underneath the flexible domes, and an electrically conductive pellet on an underside of the flexible domes for selectively engaging the spaced apart electrical traces, the switch having a first position in which each of the two downwardly spaced apart legs straddles the outside of an associated nub, the keycap being movable to a second position by depressing on a first end of the keycap causing the first leg to force a first end of the lever bar downward to collapse the first dome and so that the first leg rides over the first nub and is latched between the first and second nubs, the keycap being movable to a third position by depressing a second end of the top surface causing the second leg to force the second end of the lever bar downward to collapse the second dome and wherein the second leg rides over the second nub and is latched between the first and second nubs.

2. A latching switch as set forth in claim 1 wherein in said second position the second flexible dome is fully extended and not collapsed.

3. A latching switch as set forth in claim 1 wherein said third position the first dome is fully extended and not collapsed.

4. A latching switch as set forth in claim 1 wherein each of the first and second nubs have opposed outside and inside ramped surfaces.

5. A latching switch as set forth in claim 4 wherein the apex of each ramped nub is positioned on the lever bar at a point approximately one-third the distance between the center lines of the flexible domes.

* * * * *